US008514150B2

(12) United States Patent
Kim et al.

(10) Patent No.: US 8,514,150 B2
(45) Date of Patent: Aug. 20, 2013

(54) PLASMA DISPLAY APPARATUS

(75) Inventors: Seok Ho Kim, Gumi-si (KR); Hyun Jae Kim, Gumi-si (KR); Dong Hyun Park, Gumi-si (KR)

(73) Assignee: LG Electronics Inc., Seoul (KR)

( * ) Notice: Subject to any disclaimer, the term of this patent is extended or adjusted under 35 U.S.C. 154(b) by 1014 days.

(21) Appl. No.: 12/487,697

(22) Filed: Jun. 19, 2009

(65) Prior Publication Data

US 2010/0053036 A1 Mar. 4, 2010

(30) Foreign Application Priority Data

Aug. 29, 2008 (KR) ..... 10-2008-0085323

(51) Int. Cl.
*G09G 3/28* (2006.01)

(52) U.S. Cl.
USPC ..... 345/60

(58) Field of Classification Search
USPC ..... 345/60
See application file for complete search history.

(56) References Cited

U.S. PATENT DOCUMENTS

| | | | | |
|---|---|---|---|---|
| 6,288,693 | B1 * | 9/2001 | Song et al. | 345/68 |
| 6,362,800 | B1 * | 3/2002 | Moon | 345/60 |
| 2003/0222835 | A1 * | 12/2003 | Yoon et al. | 345/60 |
| 2005/0225504 | A1 * | 10/2005 | Kim | 345/60 |
| 2006/0103597 | A1 * | 5/2006 | Ito | 345/63 |
| 2006/0103601 | A1 * | 5/2006 | Kim | 345/67 |
| 2007/0126660 | A1 * | 6/2007 | Nagao et al. | 345/60 |
| 2008/0238822 | A1 * | 10/2008 | Lee | 345/60 |
| 2009/0058765 | A1 * | 3/2009 | Hashimoto et al. | 345/60 |

* cited by examiner

*Primary Examiner* — Alexander S Beck
*Assistant Examiner* — Joseph Pena
(74) *Attorney, Agent, or Firm* — Fish & Richardson P.C.

(57) ABSTRACT

A plasma display apparatus according to the present invention can drive a panel at a high speed, and reduce a brightness difference which may be generated in block driving, to thereby improve picture quality of a display image.

17 Claims, 10 Drawing Sheets

PLASMA DISPLAY APPARATUS

CROSS-REFERENCE TO RELATED APPLICATION

This application claims under 35 U.S.C. §119(a) the benefit of Korean Patent Application No. 10-2008-0085323 filed Aug. 29, 2008, the entire contents of which are incorporated herein by reference.

BACKGROUND OF THE INVENTION

1. Field of the Invention

The present invention relates to a plasma display apparatus, and more particularly, to an apparatus for driving a plasma display panel.

2. Description of the Conventional Art

A plasma display apparatus includes a panel in which a plurality of discharge cells are formed between a rear substrate, having barrier ribs formed therein, and a front substrate. The plasma display apparatus is an apparatus displaying an image by emitting phosphors with vacuum ultraviolet rays, which are generated by selectively discharging the plurality of discharge cells according to input picture signals.

In order to display an image effectively, the plasma display apparatus generally includes a driving controller, which processes input picture signals and outputs the processed signals to a driver for supplying driving signals to the plurality of electrodes included in the panel.

In the case of a plasma display apparatus having a large-sized screen, since a time margin for driving a panel is deficient, it is necessary to drive the panel at a high speed.

SUMMARY OF THE INVENTION

In accordance with one embodiment of the present invention for achieving the foregoing object, there is provided a plasma display apparatus including a plurality of scan electrodes and sustain electrodes formed on an upper substrate, and a plurality of address electrodes formed on a lower substrate, wherein the plurality of scan electrodes are divided into two or more groups including first and second groups, and at least one of a plurality of subfields constituting a frame includes a first sustain period during which a discharge occurs in the first group, and a second sustain period during which a plurality of sustain signals are supplied to the first and second groups, one or more erase signals being supplied to between the plurality of sustain signals supplied to the first group in the second sustain period.

In accordance with another embodiment of the present invention, there is provided a plasma display apparatus, wherein at least one of a plurality of subfields constituting a frame includes a first sustain period during which a discharge occurs in the first group, and a second sustain period during which a plurality of sustain signals are supplied to the first and second groups, the number of the sustain signals supplied to the first group being smaller than the number of the sustain signals supplied to the second group in the second sustain period.

The plasma display apparatus according to the present invention can drive a panel at a high speed, and reduce a brightness difference which may be generated in block driving, to thereby improve picture quality of a display image.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

Figure 1:
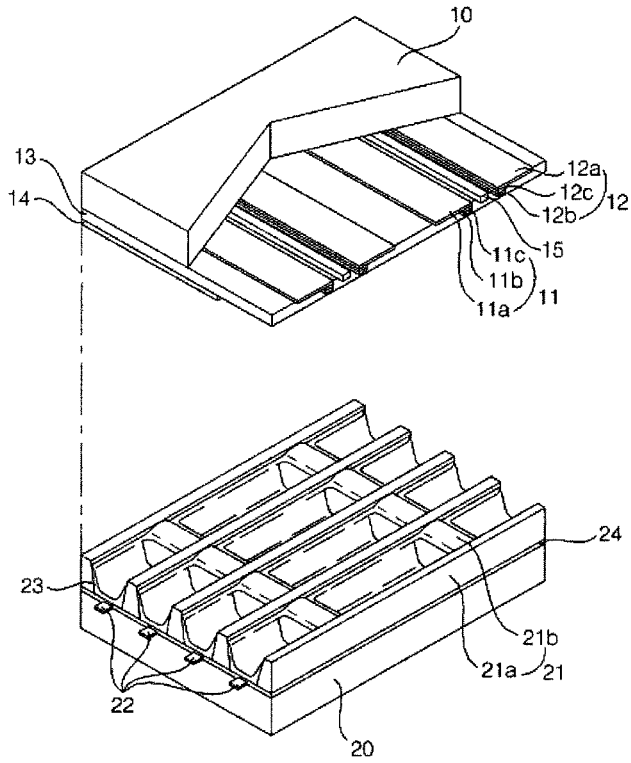
FIG. 1 is a perspective view showing an embodiment with respect to the structure of a plasma display panel.

Hereinafter, a method of driving a plasma display panel and a plasma display apparatus employing the same according to the preset invention will be described in detail with reference to the accompanying drawings. FIG. 1 is a perspective view showing an embodiment with respect to the structure of a plasma display panel according to the present invention.

As shown in FIG. 1, the plasma display panel includes scan electrodes 11 and sustain electrodes 12 (i.e., sustain electrode pairs), which are formed over a front substrate 10, and address electrodes 22 formed over a rear substrate 20.

Each sustain electrode pair 11 and 12 includes transparent electrodes 11*a* and 12*a*, generally formed from indium-tin-oxide (ITO), and bus electrodes 11*b* and 12*b*. The bus electrodes 11*b* and 12*b* may be formed from metal, such as silver (Ag) or chrome (Cr), a stack type of Cr/copper (Cu)/Cr or Cr/aluminum (Al)/Cr. The bus electrodes 11*b* and 12*b* are formed on the transparent electrodes 11*a* and 12*a*, and function to decrease a voltage drop caused by the transparent electrodes 11*a* and 12*a* with a high resistance.

Meanwhile, according to an embodiment of the present invention, the sustain electrode pair 11 and 12 may have a stack structure of the transparent electrodes 11*a* and 12*a* and the bus electrodes 11*b* and 12*b*, but also include only the bus electrodes 11*b* and 12*b* without the transparent electrodes 11*a* and 12*a*. This structure is advantageous in that it can save the manufacturing cost of the plasma display panel because the transparent electrodes 11*a* and 12*a* are not used. The bus electrodes 11*b* and 12*b* used in the structure may also be formed using a variety of materials, such as a photosensitive material, other than the above-listed materials.

Black matrices 15 are arranged between the transparent electrodes 11*a* and 12*a* and the bus electrodes 11*b* and 12*b* of the scan electrode 11 and the sustain electrode 12. The black matrix 15 has a light-shielding function of absorbing external light generated outside the front substrate 10 and decreasing reflection of the light and a function of improving the purity and contrast of the front substrate 10.

The black matrices 15 according to an embodiment of the present invention are formed over the front substrate 10. Each black matrix 15 may include a first black matrix 15 formed at a location where it is overlapped with a barrier rib 21, and second black matrices 11*c* and 12*c* formed between the transparent electrodes 11*a* and 12*a* and the bus electrodes 11*b* and 12*b*. The first black matrix 15, and the second black matrices 11*c* and 12*c*, which are also referred to as black layers or black electrode layers, may be formed at the same time and, therefore, may be connected physically. Alternatively, they may not be formed at the same time and, therefore, may not be connected physically.

Further, in the case in which the first black matrix 15 and the second black matrices 11*c* and 12*c* are connected to each other physically, the first black matrix 15 and the second black matrices 11*c* and 12*c* are formed using the same material. However, in the case in which the first black matrix 15 and the second black matrices 11*c* and 12*c* are physically separated from each other, they may be formed using different materials.

An upper dielectric layer 13 and a protection layer 14 are laminated over the front substrate 10 in which the scan electrodes 11 and the sustain electrodes 12 are formed in parallel. Charged particles generated by a discharge are accumulated on the upper dielectric layer 13. The upper dielectric layer 13 and the protection layer 14 may function to protect the sustain electrode pair 11 and 12. The protection layer 14 functions to protect the upper dielectric layer 13 from sputtering of charged particles generated at the time of a gas discharge and also increase emission efficiency of secondary electrons.

The address electrodes 22 cross the scan electrodes 11 and the sustain electrodes 12. A lower dielectric layer 24 and the barrier ribs 21 are formed over the rear substrate 20 over which the address electrodes 22 are formed.

Phosphor layers 23 are formed on the surfaces of the lower dielectric layer 24 and the barrier ribs 21. Each barrier rib 21 has a longitudinal barrier rib 21*a* and a traverse barrier rib 21*b* formed in a closed type. The barrier rib 21 functions to partition discharge cells physically and prevent ultraviolet rays, which are generated by a discharge, and a visible ray from leaking to neighboring discharge cells.

The embodiment of the present invention may also be applied to not only the structure of the barrier ribs 21 shown in FIG. 1, but also various forms of structures of the barrier ribs 21. For example, the present embodiment may be applied to a differential type barrier rib structure in which the longitudinal barrier rib 21*a* and the traverse barrier rib 21*b* have different heights, a channel type barrier rib structure in which a channel, which can be used as an exhaust passage, is formed in at least one of the longitudinal barrier rib 21*a* and the traverse barrier rib 21*b*, a hollow type barrier rib structure in which a hollow is formed in at least one of the longitudinal barrier rib 21*a* and the traverse barrier rib 21*b*, and so on.

In the differential type barrier rib structure, the traverse barrier rib 21*b* may preferably have a higher height than the longitudinal barrier rib 21*a*. In the channel type barrier rib structure or the hollow type barrier rib structure, a channel or hollow may be preferably formed in the traverse barrier rib 21*b*.

Meanwhile, in the present embodiment, it has been described and shown that the red (R), green (G), and blue (B) discharge cells are arranged on the same line. However, they may be arranged in different forms. For example, the R, G, and B discharge cells may also have a delta type arrangement of a triangle. Alternatively, the discharge cells may be arranged in various forms, such as square, pentagon and hexagon.

Furthermore, the phosphor layer 23 is excited with ultraviolet rays generated during the discharge of a gas, thus generating a visible ray of one of R, G, and B. Discharge spaces between the front/rear substrates 10 and 20 and the barrier ribs 21 are injected with an inert mixed gas for a discharge, such as He+Xe, Ne+Xe or He+Ne+Xe.

Figure 2:
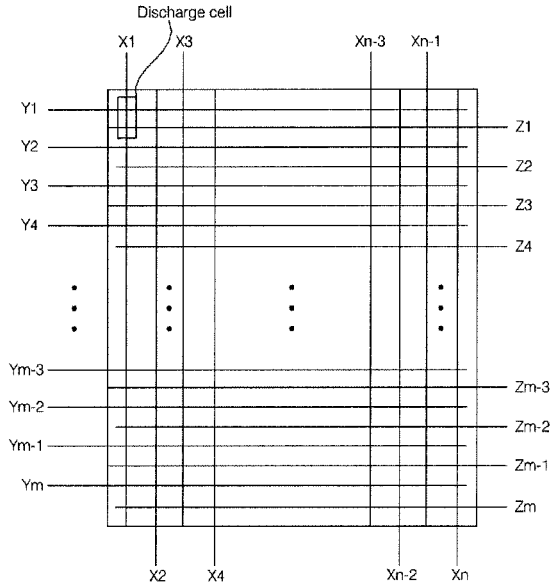
FIG. 2 is a diagram showing an embodiment with respect to the arrangement of electrodes of the plasma display panel.

FIG. 2 is a diagram showing an embodiment with respect to the arrangement of electrodes of the plasma display panel. It may be preferred that a plurality of discharge cells constituting the plasma display panel be arranged in matrix form, as illustrated in FIG. 2. The plurality of discharge cells are disposed at the intersections of scan electrode lines Y1 to Ym, sustain electrodes lines Z1 to Zm, and address electrodes lines X1 to Xn, respectively. The scan electrode lines Y1 to Ym may be driven sequentially or at the same time. The sustain electrode lines Z1 to Zm may be driven sequentially or at the same time. The address electrode lines X1 to Xn may be driven by dividing them into even-numbered lines and odd-numbered lines or driving them sequentially.

The electrode arrangement shown in FIG. 2 is only an embodiment with respect to the electrode arrangement of the plasma display panel according to the present invention. Accordingly, the present invention is not limited to the electrode arrangement and the method of driving the plasma display panel shown in FIG. 2. For example, the present invention may be applied to a dual scan method of driving two of the scan electrode lines Y1 to Ym at the same time. Alternatively, the address electrode lines X1 to Xn may be driven by dividing them into upper and lower parts on the basis of the center of the plasma display panel.

Figure 3:
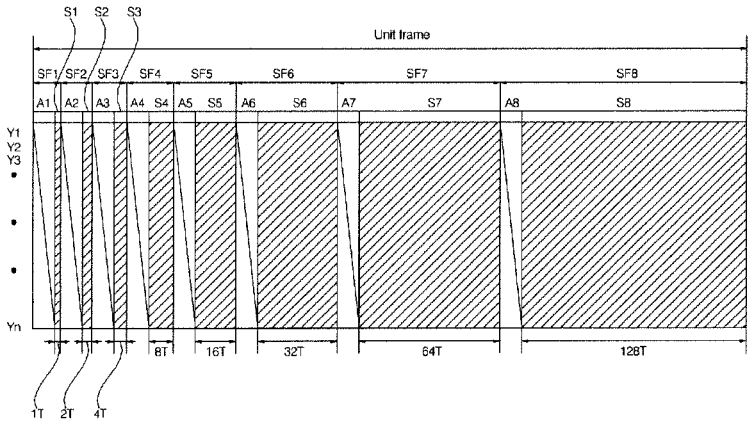
FIG. 3 is a timing diagram showing an embodiment with respect to a method of dividing one frame into a plurality of subfields and driving a plasma display panel in a time-divided manner.

FIG. 3 is a timing diagram showing an embodiment with respect to a method of dividing one frame into a plurality of subfields and driving a plasma display panel in a time-divided manner. A unit frame may be divided into a predetermined number (for example, eight) of subfields SF1, . . . , SF8 in order to realize a time dividing gray level display. Each of the subfields SF1, . . . , SF8 is divided into a reset period (not shown), address periods A1, . . . , A8, and sustain periods S1, . . . , S8.

According to an embodiment of the present invention, the reset period may be omitted in at least one of the plurality of subfields. For example, the reset period may exist only in the first subfield, or exist only in a subfield approximately between the first subfield and the entire subfields.

In each of the address periods A1, . . . , A8, a display data signal is applied to the address electrode X, and scan signals corresponding to the scan electrodes Y are sequentially applied to the address electrode X.

In each of the sustain periods S1, . . . , S8, a sustain pulse is alternately applied to the scan electrodes Y and the sustain electrodes Z. Accordingly, a sustain discharge is generated in discharge cells on which wall charges are formed in the address periods A1, . . . , A8.

The luminance of the plasma display panel is proportional to the number of sustain discharge pulses within the sustain periods S1, . . . , S8, which is occupied in a unit frame. In the case in which one frame to form 1 image is represented by eight subfields and 256 gray levels, different numbers of sustain pulses may be sequentially allocated to the respective subfields at a ratio of 1, 2, 4, 8, 16, 32, 64, and 128. For example, in order to obtain the luminance of 133 gray levels, a sustain discharge can be generated by addressing the cells during the subfield1 period, the subfield3 period, and the subfield8 period.

The number of sustain discharges allocated to each subfield may be varied depending on the weight of a subfield according to an automatic power control (APC) step. In other words, although an example in which one frame is divided into eight subfields has been described with reference to FIG. 3, the present invention is not limited to the above example, but the number of subfields to form one frame may be changed in various ways depending on design specifications. For example, the plasma display panel may be driven by dividing one frame into eight or more subfields, such as 12 or 16 subfields.

Further, the number of sustain discharges allocated to each subfield may be changed in various ways in consideration of gamma characteristics or panel characteristics. For example, the degree of gray levels allocated to the subfield4 may be lowered from 8 to 6, and the degree of gray levels allocated to the subfield6 may be raised from 32 to 34.

Figure 4:
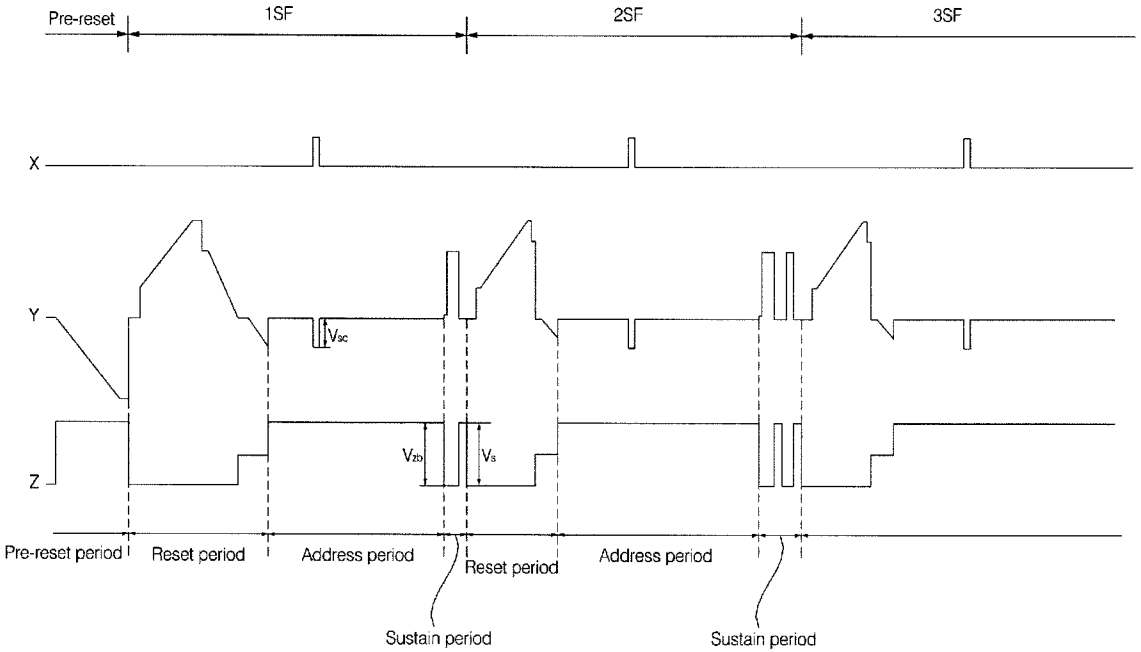
FIG. 4 is a timing diagram showing an embodiment with respect to waveforms of driving signals for driving the plasma display panel.

FIG. 4 is a timing diagram showing an embodiment with respect to waveforms of driving signals for driving the plasma display panel.

Each subfield includes a pre-reset period during which positive wall charges are formed on the scan electrodes Y and negative wall charges are formed on the sustain electrodes Z, a reset period during which discharge cells of the entire screen are reset using wall charge distributions formed in the pre-reset period, an address period during which discharge cells are selected, and a sustain period during which the discharge of selected discharge cells is sustained.

The reset period includes a set-up period and a set-down period. In the set-up period, a ramp-up waveform is applied to the entire scan electrodes at the same time, so that a minute discharge occurs in the entire discharge cells and wall charges are generated accordingly. In the set-down period, a ramp-down waveform, which falls from a positive voltage lower than a peak voltage of the ramp-up waveform, is applied to the entire scan electrodes Y at the same time, so that an erase discharge occurs in the entire discharge cells. Accordingly, unnecessary charges are erased from the wall charges generated by the set-up discharge and spatial charges.

In the address period, scan signals, each having scan voltages (Vsc) of negative polarity, are sequentially applied to the scan electrodes Y and, at the same time, data signals of positive polarity are applied to the address electrodes X. Address discharge is generated by a voltage difference between the scan signal and the data signal and a wall voltage generated during the reset period, so the cells are selected. Meanwhile, in order to enhance the efficiency of the address discharge, a sustain bias voltage (Vzb) is applied to the sustain electrode during the address period.

During the address period, the plurality of scan electrodes Y may be divided into two or more groups and sequentially supplied with the scan signals on a group basis. Each of the divided groups may be divided into two or more subgroups and sequentially supplied with the scan signals on a subgroup basis. For example, the plurality of scan electrodes Y may be divided into a first group and a second group. For example, the scan signals may be sequentially supplied to the scan electrodes belonging to the first group, and then sequentially supplied to the scan electrodes belonging to the second group.

In an embodiment of the present invention, the plurality of scan electrodes Y may be divided into a first group, located at an even-numbered position, and a second group, located at an odd-numbered position, depending upon positions where the electrodes are formed on the panel. In another embodiment, the plurality of scan electrodes Y may be divided into a first group, disposed on an upper side, and a second group, disposed on a lower side, on the basis of the center of the panel.

The scan electrodes, which belong to the first group divided according to the above method, may be divided into a first subgroup located at an even-numbered position and a second subgroup located at an odd-numbered position, or a first subgroup disposed on an upper side and a second subgroup disposed on a lower side on the basis of the center of the first group.

In the sustain period, a sustain pulse having a sustain voltage (Vs) is alternately applied to the scan electrodes and the sustain electrodes, so a sustain discharge is generated between the scan electrodes and the sustain electrodes in a surface discharge fashion.

The width of a first sustain signal or a last sustain signal, of the plurality of sustain signals, which are alternately applied to the scan electrodes and the sustain electrodes in the sustain period, may be greater than that of the remaining sustain pulses.

After the sustain discharge is generated, an erase period in which wall charges remaining in scan electrodes or sustain electrodes of an on-cell selected in the address period are erased by generating a weak discharge may be further included posterior to the sustain period.

The erase period may be included in all the plurality of subfields or some of the plurality of subfields. In this erase period, it may be preferred that an erase signal for the weak discharge may be applied to electrodes to which the last sustain pulse was not applied in the sustain period.

The erase signal may include a ramp form signal that gradually rises, a low-voltage wide pulse, a high-voltage narrow pulse, an exponential signal, a half-sinusoidal pulse or the like.

In addition, in order to generate the weak discharge, a plurality of pulses may be applied to the scan electrodes or the sustain electrodes sequentially.

The driving waveforms shown in FIG. 4 illustrate embodiments with respect to signals for driving the plasma display panel according to the present invention. However, the present invention is not limited to the waveforms shown in FIG. 4. For instance, the pre-reset period may be omitted, the polarities and voltage levels of the driving signals shown in FIG. 4 may be changed according to conditions, and an erase signal for erasing wall charges may be applied to the sustain electrodes after the sustain discharge is completed. Alternatively, a single sustain driving method of generating a sustain discharge by applying the sustain signal to either the scan electrodes Y or the sustain electrodes Z is also possible.

Figure 5:
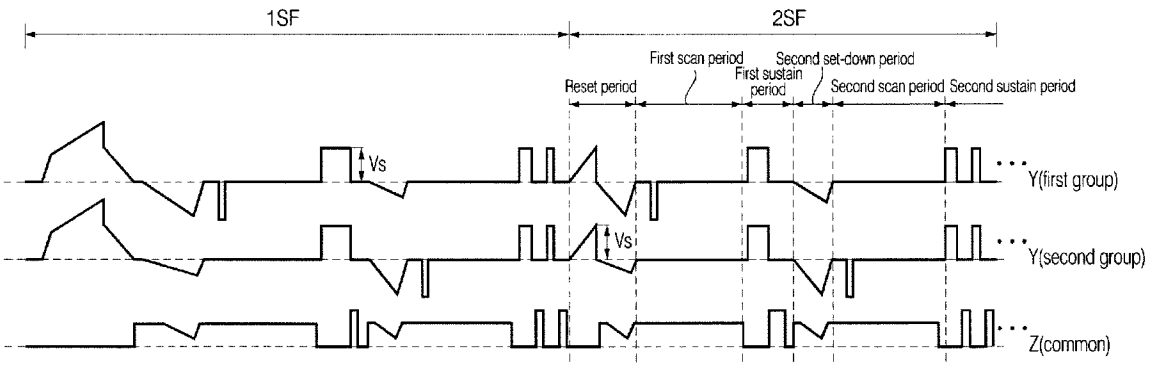
FIG. 5 is a timing diagram showing an embodiment with respect to an apparatus for dividing scan electrodes of the plasma display panel into two groups and driving the same.

The scan electrodes may be divided into two or more groups and driven. FIG. 5 is a timing diagram showing an embodiment of dividing the scan electrodes of the plasma display panel into two groups and driving the same. The plurality of scan electrodes may be divided into a first group located at an even-numbered position, and a second group located at an odd-numbered position.

The explanation will be made mainly in connection with a second subfield 2SF. At least one subfield may include a reset period, a plurality of scan and sustain periods, and a set-down period.

The reset period is a period during which wall charge states formed in the entire scan electrodes Y of the entire groups, i.e. the first and second groups are reset.

In the first scan period, a scan pulse is applied with respect to the discharge cells formed by the scan electrodes of the first group, and correspondingly, a data pulse is applied to the address electrodes to perform an address operation. Therefore, the cells to be on are selected from among the scan electrodes of the first group. It leads to the first sustain period during which the cells to be on of the first group are sustain-discharged.

Thereafter, the second set-down period may be further included to erase unnecessary wall charges.

Next, in the second scan period, a scan pulse is applied with respect to the discharge cells formed by the scan electrodes of the second group, and correspondingly, a data pulse is applied to the address electrodes to perform an address operation. Accordingly, the cells to be on are selected from among the scan electrodes of the second group. Then, it leads to the second sustain period during which the cells to be on of the second group are sustain-discharged. According to a required discharge frequency of the corresponding subfield, the second sustain period may further include a period during which the entire cells to be on are sustain-discharged, after the sustain discharge of the second group.

As described above, when the cells constituting the panel are divided by electrode lines and driven, the address operation and the sustain discharge are performed on the first group, and then performed on the second group. Thus, a time to perform the address operation on the first group and then the sustain discharge thereon is shorter than a time to perform the address operation on the entire line scan electrodes and then the sustain discharge thereon. As a result, a temporal gap between the address (scan) period and the sustain period is minimized, so that it is possible to smoothly generate the sustain discharge in the sustain period.

Although a pair of sustain signals applied in the first sustain period serve to widen a driving margin, a discharge by the pair of sustain signals may generate a brightness difference between the electrodes of the first group and the second group due to a time difference with the second sustain period and a change of the wall charge state. That is, a striping phenomenon that the electrode lines of the first group scanned first and discharged by the pair of sustain signals look brighter than the electrode lines of the second group may occur.

The brightness of the plasma display panel is proportional to the number of the sustain signals in the sustain period which occupy a unit frame. Therefore, since the number of the sustain signals in the sustain period decreases in low gray level display, the discharge by the pair of sustain signals is given much weight, which accelerates occurrence of such a phenomenon.

Figure 6:
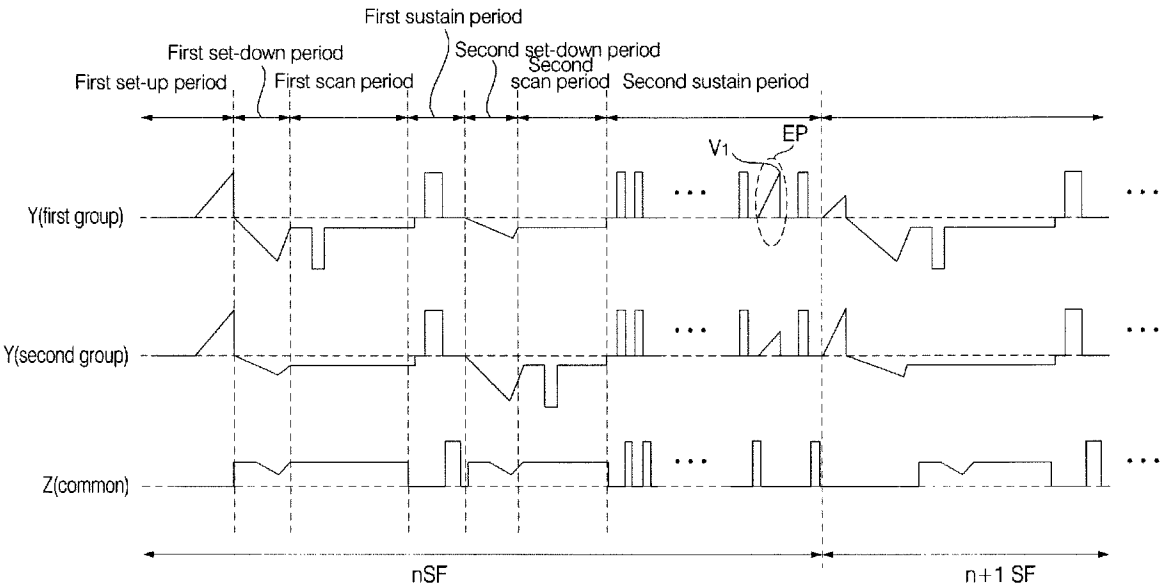
FIG. 6 is a timing diagram showing another embodiment with respect to the apparatus for dividing the scan electrodes of the plasma display panel into two groups and driving the same.

The scan electrodes may be divided into two or more groups and driven. FIG. 6 is a timing diagram showing another embodiment with respect to the plasma display apparatus for dividing the scan electrodes of the plasma display panel into two groups and driving the same.

The plasma display apparatus according to the present invention includes a plurality of scan electrodes and sustain electrodes formed on an upper substrate, and a plurality of address electrodes formed on a lower substrate.

The plurality of scan electrodes are divided into two or more groups including first and second groups, and at least one of a plurality of subfields constituting a frame includes a first sustain period during which a discharge occurs in the first group, and a second sustain period during which a plurality of sustain signals are supplied to the first and second groups.

In the second sustain period, one or more erase signals are supplied to between the plurality of sustain signals supplied to the first group.

The plurality of scan electrodes may be divided into the first group located at an even-numbered position, and the second group located at an odd-numbered position.

As shown in FIG. 6, a driving signal according to the present invention includes a first scan period during which a scan signal is supplied to the first group, a second scan period during which a scan signal is supplied to the second group, and a first sustain period between the first and second scan periods. In addition, the driving signal may further include a second set-down period.

Figure 7:
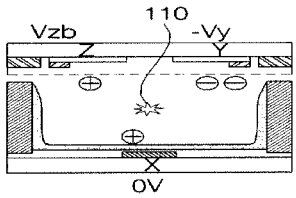
FIGS. 7 to 9 are views showing wall charge states in respective periods of a subfield according to the present invention.
Figure 8:
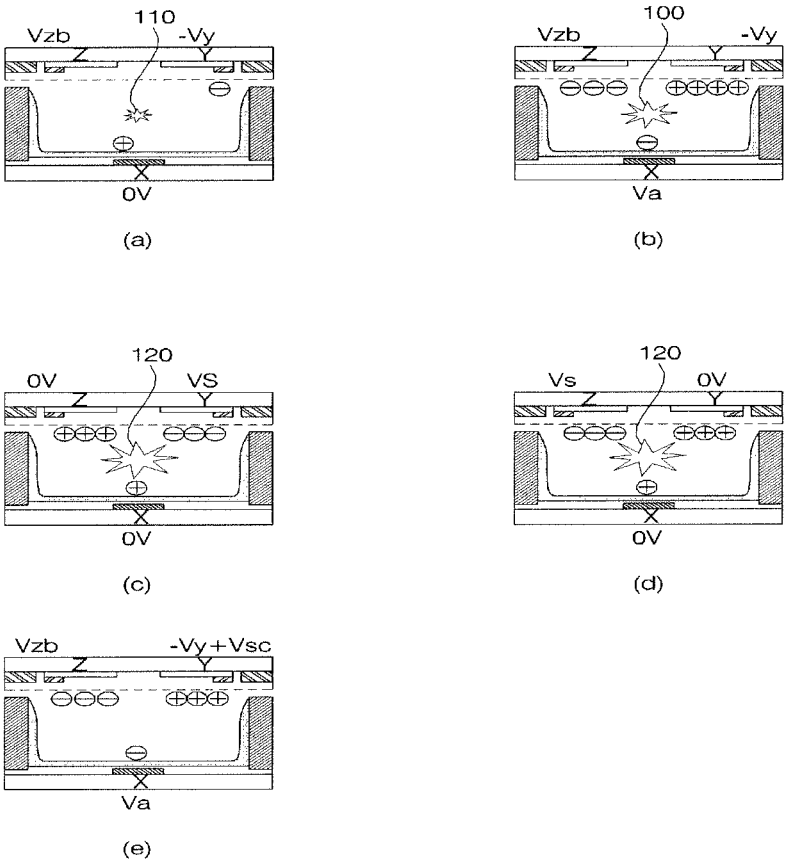
Figure 9:
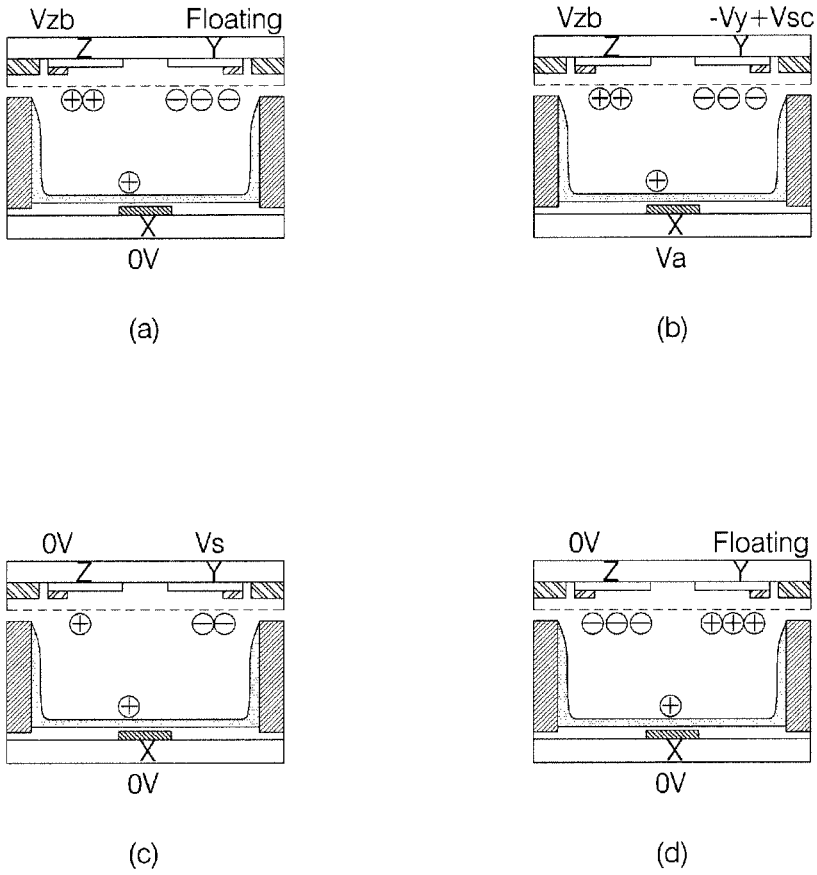

FIGS. 7 to 9 are views showing wall charge states in the respective periods of the subfield according to the present invention. While FIG. 6 and FIGS. 7 to 9 are explained together, similar or same portions to the above description will be omitted or explained briefly.

In the first set-up period, a voltage of positive polarity is applied to the entire scan electrodes Y to generate a set-up discharge, thereby accumulating wall charges. FIG. 7 is a view showing the wall charge state by the discharge in the first set-up period.

A reset signal supplied to the scan electrodes includes a first-set-up period during which the reset signal rises to a second voltage, and a first set-down period during which the reset signal falls from the second voltage to a third voltage, and gradually falls from the fourth voltage to a voltage of negative polarity. A bias voltage Vzb may be supplied to the sustain electrodes, overlapping with at least some portion of the reset signal.

The signal gradually falling to the voltage of negative polarity is supplied to the scan electrodes Y in the first set-down period during the reset period, so that unnecessary charges are erased from among the wall charges formed on the scan electrodes Y in the set-up period.

In more detail, during the set-down period, the gradually-falling signal is supplied to the scan electrodes Y, and the bias voltage Vzb of positive polarity is supplied to the sustain electrodes Z. Therefore, a weak discharge occurs between both electrodes, which erases unnecessary wall charges.

As the second subfield succeeds the sustain period of the previous subfield, it is possible to use the wall charge state formed by a sustain discharge of the previous subfield. Accordingly, a sufficient reset discharge can be generated using a reset signal having a highest voltage lower than that of the first subfield.

Moreover, in the first set-down period, the scan electrodes of the second group may be floated to make a voltage gradually fall. So as to simplify the circuit construction, the second voltage may be a sustain voltage and the third voltage may be a ground voltage.

Hereinafter, the driving signal supplied to the scan electrodes of the first group will be explained first.

As shown in FIG. 8(*a*), since a voltage of the scan electrodes gradually falls to a voltage of negative polarity −Vy in the first set-down period, a weak discharge 110 occurs, erasing excessively accumulated unnecessary wall charges.

Negative (−) charges of negative polarity are formed on the scan electrodes Y of the first group during the reset period for an address discharge, a driving signal supplied to the scan electrodes Y of the first group in the first scan period sustains a scan bias voltage or a ground voltage, a scan signal of negative polarity is sequentially supplied, and at the same time, a data signal Va of positive polarity is applied to the address electrodes X, so that the address discharge occurs.

FIG. 8(*b*) is a view showing the wall charge state in the first scan period. A discharge 100 occurs due to a voltage difference between the scan signal and the data signal and the wall voltage generated during the reset period, so that the cells to be on are selected. Meanwhile, since a signal sustaining a sustain bias voltage Vzb is applied to the sustain electrodes Z during the set-down period and the address period, it is possible to prevent an erroneous discharge from occurring between the sustain electrodes and the other electrodes.

Thereafter, it sequentially leads to the first sustain period during which a sustain voltage is alternately supplied to the scan electrodes and the sustain electrodes. FIGS. 8(*c*) and 8(*d*) are schematic views showing the wall charge states of the scan electrodes of the first group in the first sustain period.

The wall charge state of FIG. 8(*b*) continues, a voltage is not applied to the sustain electrodes Z and the address electrodes X, and a sustain voltage of positive polarity is applied to the scan electrodes Y. Accordingly, the sum of the wall charges accumulated on the scan electrodes Y and the external voltage applied to the scan electrodes Y is over a discharge firing voltage, so that a sustain discharge occurs.

Since the sustain discharge is a strong discharge 120 and the external voltage is continuously applied, polarity of the wall charge distribution is reversed after the discharge. In addition, since the address electrodes X have a relatively low voltage, the wall charges on the address electrodes X can be converted into a small amount of wall charges of positive polarity.

The number of the sustain signals supplied respectively to the scan electrodes and the sustain electrodes in the first sustain period may be different.

In FIG. 8(*d*), a voltage of positive polarity is applied to the scan electrodes and the sustain electrodes. However, FIGS. 8(*c*) and 8(*d*) are similar in operation.

The second set-down period may be further included after the first sustain period. In the second set-down period, a signal having a gradually-falling voltage may be applied to the first and second groups. In addition, a falling slope of the signal having the gradually-falling voltage, which is applied to the first group, may be greater than a falling slope of the signal having the gradually-falling voltage, which is applied to the second group.

Since an address operation is performed on the second group in the second scan period, a second set-down signal which gradually falls is supplied just before the scan period to make the wall charges uniform, thereby maintaining the wall charge state appropriate for an address discharge. In this case, the scan electrodes of the first group may be floated to make the voltage of the first group gradually fall.

The wall charge state as shown in FIG. 8(*e*) is formed in the second scan period. Not a scan signal but a scan bias voltage is applied to the scan electrodes Y of the first group, and a sustain bias voltage Vzb is applied to the sustain electrodes. Since an external applied voltage is absent or small, an address discharge does not occur.

A sustain signal is alternately applied to the scan electrodes and the sustain electrodes in the second sustain period, so that a sustain discharge occurs due to the wall charge distributions of FIGS. 8(*c*) and 8(*d*) and the external applied voltage. The number of the sustain discharges may be varied in each subfield according to variations of the number of the sustain signals.

In at least one of the plurality of subfields according to the present invention, as shown in FIG. 6, one or more erase signals EP are applied to between the plurality of sustain signals supplied to the first group in the second sustain period.

As the wall charges are erased by the erase signal EP, a sustain discharge does not occur in the first group by the last sustain signal, which compensates for a brightness difference which may be generated because the sustain discharge has occurred in the first group and has not occurred in the second group during the first sustain period in low gray level display having a small number of sustain discharges.

A discharge by a pair of sustain signals in the first sustain period may generate a brightness difference between the electrodes of the first group and the second group due to a time difference with the second sustain period and change of the wall charge state.

That is, a striping phenomenon that the electrode lines of the first group scanned first and discharged by the pair of sustain signals look brighter than the electrode lines of the second group may occur. Particularly, the discharge by the pair of sustain signals is given much weight in low gray level display having a small number of sustain discharges, which accelerates occurrence of such a phenomenon.

The erase signal may be a ramp waveform gradually rising to a first voltage. As the voltage change is slow, it is possible to prevent a strong discharge and generate a weak discharge. The wall charges are erased due to the weak discharge by the erase signal, so that a sustain discharge by the last sustain signal does not occur in the first group.

That is, since the erase signal is supplied to between the plurality of sustain signals applied to the first group, the pair of sustain discharges do not occur in the second sustain period in the first group experiencing the discharge in the first sustain period. As a result, a strong discharge by the sustain signal following the erase signal is replaced by a weak discharge in the first group.

Accordingly, reduced is a brightness difference between the first group where the discharge has occurred in the first sustain period and the second group where the discharge has not occurred in the first sustain period. It is thus possible to prevent the striping phenomenon caused by a large brightness difference between the electrode lines of the first and second groups, and to subsequently improve picture quality of the plasma display apparatus.

In addition, taking simplification of the circuit construction and costs into consideration, the first voltage may be a sustain voltage without needing a special power circuit.

The erase signal may be supplied before the last sustain signal, particularly, to the last n-th sustain signal and the previous n−1th signal. After the last sustain signal, no more sustain signal is applied, and no more sustain discharge occurs. Moreover, since the reset period of the next subfield follows, even if the wall charges are erased by the erase signal, it does not affect the sustain discharge and so on.

Further, in this case, since the erase signal has been applied before the last sustain signal, the first group does not need a special erase signal in the next subfield.

Hereinafter, a driving signal supplied to the scan electrodes of the second group will be explained.

As shown in FIG. 9(*a*), in the first set-down period, the scan electrodes are floated to make a voltage gradually fall. Here, a falling slope of the second group is smaller than a falling slope of the first group, so that a discharge does not occur in the second group. Accordingly, the wall charge state of FIG. 7 is seldom changed.

Negative charges of negative polarity are formed on the scan electrodes Y of the first group during the reset period in the first scan period for an address discharge, a driving signal supplied to the scan electrodes Y of the first group in the first scan period sustains a scan bias voltage, a scan signal of negative polarity is sequentially supplied, and at the same time, a data signal Va of positive polarity is applied to the address electrodes X, so that the address discharge occurs.

However, in the wall charge state of FIG. 9(*b*), the scan signal is not applied to the second group, so that the address discharge does not occur.

Although a sustain voltage is applied to the sustain electrodes in the first sustain period, since the address discharge does not occur in the second group during the first scan period, the wall charge state of FIG. 9(*c*) is formed and the discharge is not generated.

Thereafter, like FIG. 9(*d*), a weak discharge is generated in the second set-down period to erase unnecessary wall charges and make the wall charge distribution uniform. The second group after the second scan period is similar to the first group after the first scan period.

In some period of the second sustain period, the scan electrodes of the second group may be floated to make a scan electrode voltage of the second group gradually change. In this case, the highest voltage in the period during which the scan electrodes of the second group are floated may be set smaller than the highest voltage of the erase signal to seldom change the wall charge state.

In addition, the period during which the scan electrodes of the second group are floated may overlap with the period during which one or more erase signals are supplied to between the plurality of sustain signals supplied to the first group. It is possible to prevent an entire timing difference of the first and second groups from being generated in the second sustain period, by adjusting the timing of the two periods identical.

Figure 10:
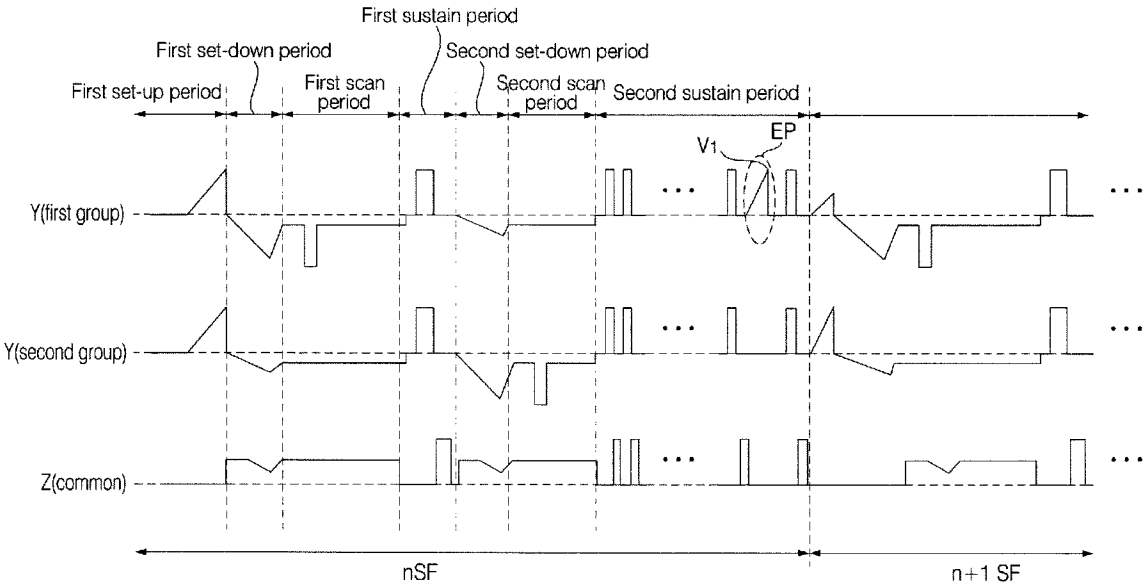
FIG. 10 is a timing diagram showing a further embodiment with respect to the apparatus for dividing the scan electrodes of the plasma display panel into two groups and driving the same.

FIG. 10 is a timing diagram showing a further embodiment with respect to the apparatus for dividing the scan electrodes of the plasma display panel into two groups and driving the same.

The embodiment of FIG. 10 is different from the embodiment of FIG. 6 in that a voltage of the second group sustains a ground voltage during a period during which an erase signal EP is supplied to the first group.

Figure 11:
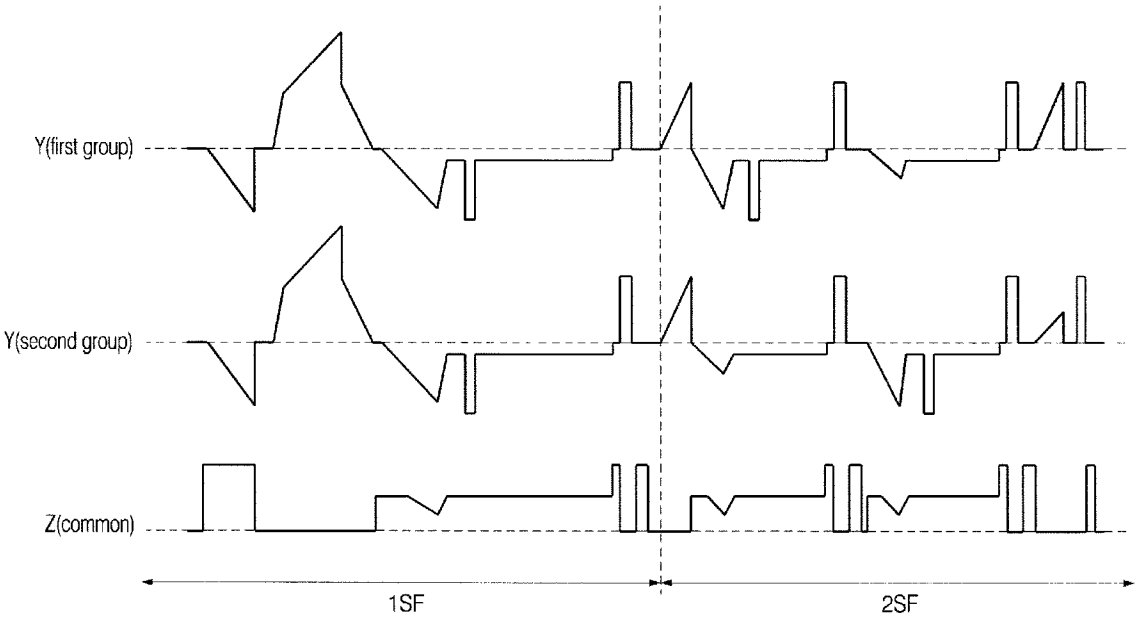
FIG. 11 is a timing diagram showing a still further embodiment with respect to the apparatus for dividing the scan electrodes of the plasma display panel into two groups and driving the same.

FIG. 11 is a timing diagram showing a still further embodiment with respect to the apparatus for dividing the scan electrodes of the plasma display panel into two groups and driving the same.

Referring to FIG. 11, the highest voltage of the scan electrodes in a first one of a plurality of subfields may be greater than the highest voltage of the scan electrodes in the other subfields. In this case, the first subfield may include a scan period during which a scan signal is sequentially supplied to the first and second groups.

That is, in the first subfield, the scan signal can be sequentially applied to the entire scan electrodes, instead of separating periods where the scan signal is supplied to the first and second groups or forming a first sustain period therebetween.

Moreover, in the subfields succeeding the first subfield, a charge state formed by a sustain discharge in the previous subfield can be used. Therefore, in the subfields succeeding the first subfield, a reset discharge is performed using a reset signal having a lower voltage than that of the first subfield, so that power consumption can be reduced.

Further, in this case, in order to compensate for a brightness difference by the first sustain period, an erase signal EP may be applied to the subfields succeeding the first subfield.

Furthermore, the erase signal of the plasma display apparatus according to the present invention may be applied to some of the plurality of subfields constituting one frame.

A discharge by a pair of sustain signals in the first sustain period may generate a brightness difference between the electrodes of the first group and the second group due to a time difference with the second sustain period and a change of the wall charge state. The brightness of the plasma display panel is proportional to the number of the sustain signals in the sustain period which occupy a unit frame. Accordingly, the number of the sustain signals in the sustain period decreases in low gray level display, so that the discharge by the pair of sustain signals is given much weight, which accelerates occurrence of such a phenomenon.

Therefore, the at least one subfield to which the erase signal is supplied may be at least one of the first to fourth subfields displaying low gray level among the plurality of subfields constituting the frame.

The plasma display apparatus according to the present invention divides the scan electrodes into a plurality of groups and drives the same, thereby accomplishing high-speed driving of the panel.

Moreover, in the plasma display apparatus according to the present invention, in the at least one of the plurality of subfields, as shown in FIG. 6, one or more erase signals EP are applied to between a plurality of sustain signals supplied to the first group in the second sustain period.

As the wall charges are erased by the erase signal EP, a sustain discharge does not occur in the first group by the last sustain signal, which compensates for a brightness difference which may be generated because the sustain discharge has occurred in the first group and has not occurred in the second group during the first sustain period in low gray level display having a small number of sustain discharges. It is thus possible to improve picture quality of a display image.

Figure 12:
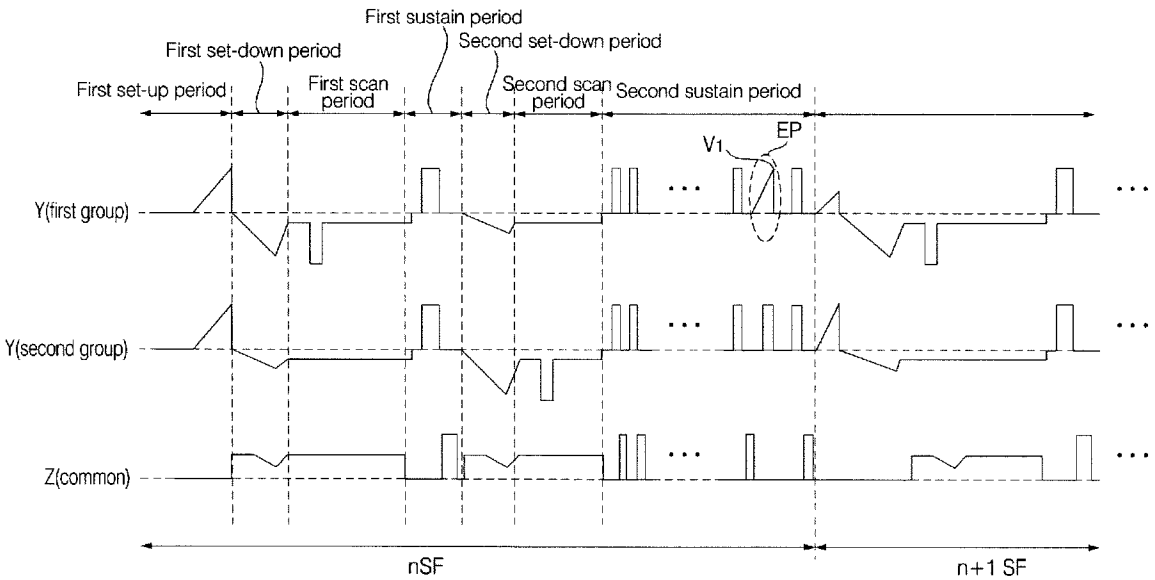
FIG. 12 is a timing diagram showing a still further embodiment with respect to the apparatus for dividing the scan electrodes of the plasma display panel into two groups and driving the same.

FIG. 12 is a timing diagram showing a still further embodiment with respect to the apparatus for dividing the scan electrodes of the plasma display panel into two groups and driving the same. Similar or same portions to the above description will be omitted or explained briefly.

In addition, the plasma display apparatus according to the present invention includes a plurality of scan electrodes and sustain electrodes formed on an upper substrate, and a plurality of address electrodes formed on a lower substrate. The plurality of scan electrodes are divided into two or more groups including first and second groups, and at least one of a plurality of subfields constituting a frame includes a first sustain period during which a discharge occurs in the first group, and a second sustain period during which a plurality of sustain signals are supplied to the first and second groups. In the second sustain period, the number of the sustain signals supplied to the first group is smaller than the number of the sustain signals supplied to the second group.

Moreover, in the second sustain period, the number of the sustain signals supplied to the first group may be smaller than the number of the sustain signals supplied to the second group by one.

When the discharge has occurred in the scan electrodes of the first group during the first sustain period, the number of the sustain signals supplied to the first group is smaller than the number of the sustain signals supplied to the second group by the number of the discharges in the second sustain period.

In a case where a pair of discharges have occurred in the first sustain period, the number of the sustain signals supplied to the first group is smaller than the number of the sustain signals supplied to the second group by one.

Further, in the second sustain period, one or more erase signals may be supplied to between the plurality of sustain signals supplied to the first group.

In this case, one or more sustain signals may be supplied to the second group during the period during which the erase signal is supplied to the first group.

A brightness difference between the first and second groups can be reduced by supplying more sustain signals to the second group according to the discharge level in the first sustain period, and fine gray level display can be accomplished by controlling the number of the sustain signals.

Furthermore, the erase signal may be a ramp waveform where a voltage gradually rises, and may be supplied before the last sustain signal.

Still furthermore, the highest voltage of the scan electrodes in the first one of the plurality of subfields may be greater than the highest voltage of the scan electrodes in the other subfields, and the at least one subfield may be at least one of the first to fourth subfields that display low gray level.

Besides, it is obvious that the features of the present invention explained with reference to FIGS. 6 to 11 are applicable to the embodiment of FIG. 12.

While the invention has been shown and described with respect to the preferred embodiments, it will be understood by those skilled in the art that various changes and modifications may be made without departing from the spirit and scope of the invention as defined in the following claims.

What is claimed is:

1. A plasma display apparatus comprising:

a plurality of scan electrodes and sustain electrodes formed on an upper substrate; and a plurality of address electrodes formed on a lower substrate, wherein the plurality of scan electrodes are divided into two or more groups including first and second groups, and wherein at least one of a plurality of subfields constituting a frame comprises a first sustain period during which a sustain discharge occurs in the first group, and a second sustain period during which a plurality of sustain signals are supplied to the first and second groups, wherein one or more erase signals are supplied to the first group between two of the plurality of sustain signals supplied to the first group in the second sustain period, wherein the erase signal is supplied before the last sustain signal of the plurality of sustain signals.

2. The plasma display apparatus of claim 1, wherein the plurality of scan electrodes are divided into the first group located at an even-numbered position, and the second group located at an odd-numbered position.

3. The plasma display apparatus of claim 1, wherein the erase signal has a ramp waveform gradually rising to a first voltage.

4. The plasma display apparatus of claim 3, wherein the first voltage is a sustain voltage.

5. The plasma display apparatus of claim 1, wherein the scan electrodes of the second group are floated in some period of the second sustain period.

6. The plasma display apparatus of claim 5, wherein the highest voltage in the period during which the scan electrodes of the second group are floated is smaller than the highest voltage of the erase signal.

7. The plasma display apparatus of claim 5, wherein the period during which the scan electrodes of the second group are floated overlaps with the period during which the one or more erase signals are supplied to between the plurality of sustain signals supplied to the first group.

8. The plasma display apparatus of claim 1, wherein the highest voltage of the scan electrodes in the first one of the plurality of subfields is greater than the highest voltage of the scan electrodes in the other subfields.

9. The plasma display apparatus of claim 8, wherein the first subfield comprises a scan period during which a scan signal is sequentially supplied to the first and second groups.

10. The plasma display apparatus of claim 1, wherein the voltage of the second group sustains a ground voltage during the period during which the erase signal is supplied to the first group.

11. The plasma display apparatus of claim 1, wherein the at least one subfield is at least one of the first to fourth subfields.

12. A plasma display apparatus comprising:

a plurality of scan electrodes and sustain electrodes formed on an upper substrate; and a plurality of address electrodes formed on a lower substrate, wherein the plurality of scan electrodes are divided into two or more groups including first and second groups, wherein at least one of a plurality of subfields constituting a frame comprises a first sustain period during which a sustain discharge occurs in the first group, and a second sustain period during which a plurality of sustain signals are supplied to the first and second groups, and wherein the number of the sustain signals supplied to the first group is smaller than the number of the sustain signals supplied to the second group in the second sustain period, wherein one or more erase signals are supplied to the first group between two of the plurality of sustain signals supplied to the first group in the second sustain period, and wherein the erase signal is supplied before the last sustain signal.

13. The plasma display apparatus of claim 12, wherein the number of the sustain signals supplied to the first group is smaller than the number of the sustain signals supplied to the second group by one in the second sustain period.

14. The plasma display apparatus of claim 12, wherein one or more sustain signals are supplied to the second group during the period during which the erase signal is supplied to the first group.

15. The plasma display apparatus of claim 12, wherein the erase signal is a ramp waveform where a voltage gradually rises.

16. The plasma display apparatus of claim 12, wherein the highest voltage of the scan electrodes in the first one of the plurality of subfields is greater than the highest voltage of the scan electrodes in the other subfields.

17. The plasma display apparatus of claim 12, wherein the at least one subfield is at least one of the first to fourth subfields.

* * * * *